US009334090B1

(12) United States Patent
Maple et al.

(10) Patent No.: US 9,334,090 B1
(45) Date of Patent: May 10, 2016

(54) LIQUID DISPENSING LID

(71) Applicants: Wade Maple, Spokane, WA (US); Jeff Steininger, S. Mary's, OH (US)

(72) Inventors: Wade Maple, Spokane, WA (US); Jeff Steininger, S. Mary's, OH (US)

(73) Assignee: ZAK DESIGNS, INC., Spokane, WA (US)

( * ) Notice: Subject to any disclaimer, the term of this patent is extended or adjusted under 35 U.S.C. 154(b) by 0 days.

(21) Appl. No.: 14/603,819

(22) Filed: Jan. 23, 2015

(51) Int. Cl.

| | |
|---|---|
| ***B65D 47/32*** | (2006.01) |
| ***B65D 43/02*** | (2006.01) |
| ***B65D 47/06*** | (2006.01) |
| ***B65D 51/18*** | (2006.01) |
| ***B65D 51/16*** | (2006.01) |

(52) U.S. Cl.

CPC ..... *B65D 47/32* (2013.01); *B65D 43/02* (2013.01); *B65D 47/06* (2013.01); *B65D 51/1644* (2013.01); *B65D 51/18* (2013.01); *B65D 2251/009* (2013.01); *B65D 2251/0025* (2013.01); *B65D 2251/0028* (2013.01); *B65D 2251/0081* (2013.01); *B65D 2251/0087* (2013.01); *B65D 2543/00046* (2013.01)

(58) Field of Classification Search

CPC .... B65D 47/32; B65D 47/06; B65D 43/0202; B65D 43/02; B65D 51/1644; B65D 51/18; A47G 19/2272; A47G 19/2205; A47G 19/2266

USPC ..... 220/254.9, 254.7, 254.5, 254.3, 254.1, 220/259.5, 259.1, 256.1, 715, 714, 713, 220/711, 203.19, 203.04, 203.01, 212, 220/259.2, 254.6, 254.2; 222/561, 559, 222/557, 556, 544

See application file for complete search history.

(56) References Cited

U.S. PATENT DOCUMENTS

| | | | | | |
|---|---|---|---|---|---|
| 2,447,870 | A * | 8/1948 | Polcyn | A47G 19/2272 | 215/309 |
| 2,578,201 | A * | 12/1951 | Nicorvo | A47G 19/2272 | 215/315 |
| 3,739,938 | A * | 6/1973 | Paz | A47G 19/2272 | 215/309 |
| 4,133,446 | A * | 1/1979 | Albert | A47G 19/2272 | 220/254.5 |
| 5,118,014 | A * | 6/1992 | Hestehave | A47G 19/2272 | 220/254.5 |
| 2013/0319966 | A1* | 12/2013 | Lane | B65D 43/26 | 215/237 |
| 2013/0320011 | A1* | 12/2013 | Tachi | A47J 41/0027 | 220/212 |
| 2014/0263476 | A1* | 9/2014 | Blain | A45F 3/18 | 222/545 |
| 2015/0060448 | A1* | 3/2015 | Coon | A47G 19/2272 | 220/254.1 |

* cited by examiner

*Primary Examiner* — Robert J Hicks
(74) *Attorney, Agent, or Firm* — Randall Danskin PS

(57) ABSTRACT

A liquid dispensing lid includes a lid body having an upper lower surface and a peripheral edge, and is sized so as to releasably cooperate with a fluid dispensing vessel having an internal cavity, and the lid body further defines a drinking aperture and a vent aperture; an elongated fluid dispensing member is mounted on the upper surface of the lid body; and an elastomeric valve member is releasably borne by the elongated fluid dispensing member, and which further is operable to move the elongated fluid dispensing member along a predetermined path of travel between a first and a second position.

33 Claims, 6 Drawing Sheets

LIQUID DISPENSING LID

TECHNICAL FIELD

The present invention relates to a liquid dispensing lid for drinking containers, and more particularly to a liquid dispensing lid which regulates the dispensing of a liquid from the internal cavity of a drinking container.

BACKGROUND OF THE INVENTION

As is well known in society, the general public is constantly in motion dealing with the tasks and activities of daily living. While attending to the necessary details of everyday living, most persons wish to have a drink, whether it be carbonated, water, coffee or the like. As such, the advent of portable drinking containers arose to permit desired drinks to be easily transported from one location to another and consumed while on the move.

Ancillary to the desire to transport the liquids is the desire to prevent such liquids from inadvertently spilling, while simultaneously permitting the user to drink the liquid on demand. Further, when consuming the desired liquid, persons also wish to avoid the needless splashing of the dispensed liquid which is sometimes occasioned by the air pressure differential which is created within the internal cavity of the drinking container, and caused by the consumption of the liquid.

In order to facilitate a consumption of a fluid, while also protecting the user from inadvertent splashing of the fluid or other liquid, a lid is desired which is operable by a single hand, and which further simultaneously equalizes the pressure of the internal cavity while the liquid is being dispensed.

Finally, such a lid, while providing benefits to the user, must not be so complex as to prevent the user from easily removing, disassembling and cleaning the lid following the use of a beverage container which is equipped with such a liquid dispensing lid.

The present invention addresses a perceived and important need for many people, in that it provides a fluid dispensing lid for a portable drinking container and which is rendered operable by a single finger, and which further avoids undesired splashing by allowing the equalization of the air pressure within the internal cavity of the drinking vessel to occur through a separate aperture while the liquid is being consumed. The liquid dispensing lid of the present invention is sized to matingly couple with standard, portable drinking containers and seal all liquid within the drinking container until the user wishes to drink a desired amount. When the user wishes to consume a certain amount of the liquid, the user simply depresses on a region of the lid and which unseals both a vent aperture and a drinking aperture within the lid. Internal pressure is then equalized through the vent aperture, and which further protects the user, while the desired liquid is permitted to pass from the internal cavity of the drinking vessel through the drinking aperture for consumption by the user. Once the user has consumed a given amount of the liquid, the user simply releases pressure on the lid region, and which will then automatically return to a sealed position, such that the user can continue with any activities and the liquid will be retained within the drinking container.

SUMMARY OF THE INVENTION

A first aspect of the present invention relates to a liquid dispensing lid which includes a lid body having an upper and lower surface, and a peripheral edge, and wherein the lid body is sized so as to releasably cooperate with a fluid dispensing vessel having an internal cavity, and wherein the lid body further defines a drinking aperture and a vent aperture; an elongated, fluid dispensing member moveably mounted on the upper surface of the lid body; and an elastomeric valve member which is releasably borne by the elongated fluid dispensing member, and wherein the valve member has a drinking aperture sealing member, and a biasing member which biasingly couples the fluid dispensing member to the lid body, and wherein the elongated, fluid dispensing member is moveable along a predetermined path of travel between a first and a second position.

Still another aspect of the present invention relates to a liquid dispensing lid which includes a lid body having an upper and lower surface, and a peripheral edge, and wherein the lid body is sized so as to releasably cooperate with a fluid dispensing vessel having an internal cavity, and wherein the lid body further defines a drinking aperture and a vent aperture which extend through the lid body, and which further communicate with the internal cavity of the fluid dispensing vessel, and wherein the lid body is further defined by a continuous gasket which is mounted near the lower surface of the lid body; an elongated, fluid dispensing member moveably mounted on the upper surface of the lid body, and having opposite first and second ends, a top surface and a bottom surface, and wherein the fluid dispensing member defines a fulcrum which is mounted on the bottom surface thereof, and wherein the fulcrum rests in forcible engagement on the upper surface of the lid body, and wherein a force, when applied to the fluid dispensing member, moves the fluid dispensing member along a predetermined path or travel between a first and second position relative to the drinking and vent apertures, respectively; and an elastomeric valve member which is releasably borne by the elongated fluid dispensing member, and wherein the elastomeric valve member has a drinking aperture sealing member; a vent aperture sealing member; and a biasing member which biasingly couples the fluid dispensing member to the lid body, and wherein the biasing member biasingly urges the fluid dispensing member into the first position along the path of travel when no force is applied to the fluid dispensing member, and wherein, when force is applied to the fluid dispensing member so as to move the fluid dispensing member along the path of travel to the second position, the fluid dispensing member simultaneously carries each of the drinking and vent sealing members to a non-occluding position relative to each of the drinking and vent apertures respectively so as to facilitate a release of a fluid which is enclosed within the internal cavity of the fluid dispensing vessel, and through the drinking aperture, and wherein the movement of the elongated fluid dispensing member along the path of travel is effective in resiliently elongating the biasing member, and wherein, upon release of the force applied to the elongated fluid dispensing member, the elongated biasing member biasingly returns the elongated fluid dispensing member along the path of travel to the first position, and which then impedes the dispensing of the fluid from the fluid dispensing vessel.

Still another aspect of the present invention relates to a liquid dispensing lid which includes a lid body having an upper and lower surface, and which is further defined by a peripheral edge, and wherein the lid body is sized so as to releasably cooperate with a fluid dispensing vessel having an internal cavity, and which encloses a source of a liquid to be dispensed, and wherein the lid body further defines a drinking aperture and a vent aperture which extend through the lid body, and which further communicate with the internal cavity of the fluid dispensing vessel, and wherein the drinking aperture has a cross sectional dimension which is greater than a cross sectional dimension of the vent aperture; an elongated, fluid dispensing member moveably mounted on the upper surface of the lid body, and wherein the fluid dispensing member has opposite first and second ends, and top and bottom surfaces, and wherein the fluid dispensing member defines a fulcrum which is mounted on the bottom surface thereof, and is further located between the first and second ends thereof, and wherein the fulcrum rests in forcible engagement on the upper surface of the of the lid body, and wherein when a force applied to the first end of the elongated fluid dispensing member, the second end of the fluid dispensing member moves along a predetermined path or travel between a first and second position relative to the drinking and vent apertures respectively; and an elastomeric valve member which is releasably borne by the second end of the elongated fluid dispensing member, and wherein the valve member has a drinking aperture sealing member; a vent aperture sealing member; and a biasing member which biasingly couples the second end of the fluid dispensing member to the upper surface of the lid body, and wherein the biasing member blasingly urges the elongated fluid dispensing member into the first position along the path of travel when no force is applied to the first end of the elongated fluid dispensing member, and wherein, in the first position the drinking and vent apertures are sealingly occluded by the respective drinking and vent sealing members, and wherein, when force is applied to the first end of the elongated fluid dispensing member so as to move the second end thereof along the path of travel, and to the second position, the elongated fluid dispensing member simultaneously carries each of the drinking and vent sealing members to a non-occluding position relative to each of the respective drinking and vent apertures so as to facilitate a release of the fluid from the internal cavity of the fluid dispensing vessel, and through the drinking aperture, and wherein the movement of the elongated fluid dispensing member from the first to the second position is effective in resiliently elongating the biasing member, and wherein, upon release of the force applied to the first end of the elongated fluid dispensing member, the biasing member biasingly returns the second end of the elongated fluid dispensing member to the first position, and which impedes the dispensing of the fluid from the fluid dispensing vessel.

These and other aspects of the present invention will be discussed in greater detail hereinafter.

BRIEF DESCRIPTION OF THE DRAWINGS

Preferred embodiments of the invention are described below with reference to the following accompanying drawings.

BRIEF DESCRIPTION OF THE PREFERRED EMBODIMENT

This disclosure of the invention is submitted in furtherance of the constitutional purposes of the U.S. Patent laws "to promote the progress of science and useful arts." (Article I, Section 8).

Figure 1:
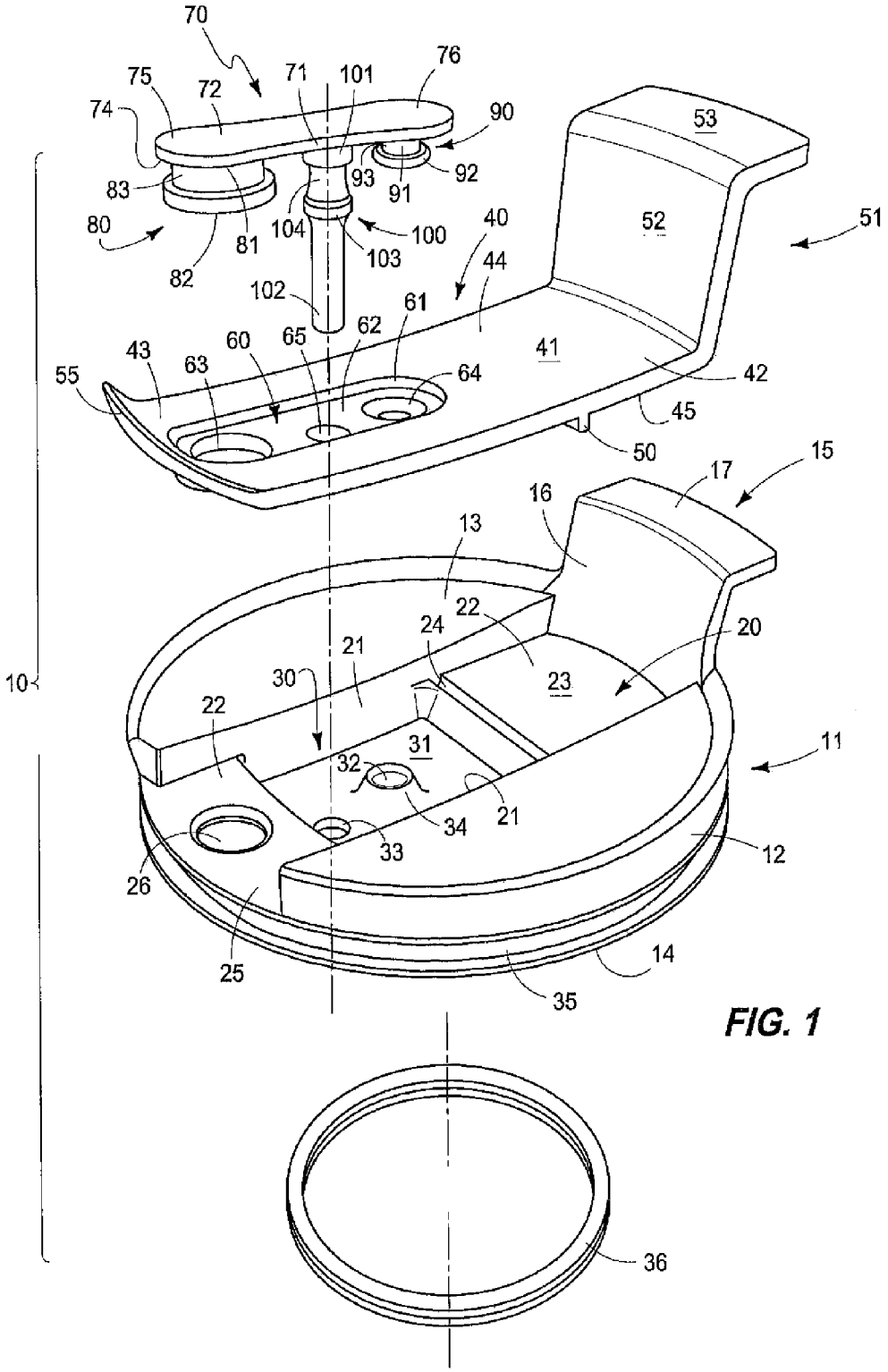
FIG. 1 is a greatly enlarged, perspective, exploded view of the fluid dispensing lid of the present invention.

The present invention relates to a liquid dispensing lid which is generally indicated by the numeral 10 in FIG. 1, and following. As seen in the drawings, the liquid dispensing lid 10 is defined, at least in part, by a lid body which is also generally indicated by the numeral 11 in the drawings which are provided. The lid body 11 is generally circular in cross section and is operable to releasably cooperate with a fluid dispensing vessel, not shown, of traditional design. The lid body 11 has a circular peripheral edge 12, and is further defined by an upper or top surface 13, and a lower or bottom surface 14. As seen in FIG. 1, a flange 15 is made integral with the upper or top surface 13 and is located along and/or near the peripheral edge 12 of the lid body 11. The flange 15 has an upwardly extending first portion which is generally indicated by the numeral 16. The upwardly extending portion 16 is further made integral with, or coupled to, a laterally outwardly extending portion which is generally indicated by the numeral 17. The operation of the flange 15 will be discussed in greater detail in the paragraphs which follow.

As seen in the drawings, the lid body 11 has formed in the upper surface 13, a first cavity which is indicated by the numeral 20. The first cavity is defined in part by a pair of parallel, spaced sidewalls 21, and a discontinuous bottom surface which is generally indicated by the numeral 22, and which further extends between the side walls 21. The first cavity 20 includes a first portion 23 having predetermined dimensions. As further seen in FIG. 1, a fulcrum engagement region 24 is formed in the bottom surface 22 of the first portion 23, and is operable to mechanically, and matingly cooperate with a fulcrum as will be described in greater detail, hereinafter. Still further the first cavity 20 is defined, at least in part, by a second portion 25. The second portion 25 is substantially co-planar with the first portion 23. The second portion 25 defines, at last in part, a drinking aperture 26, and which extends through the upper and lower surfaces 13 and 14 respectively, and which further facilitates the passage of a liquid which is stored in a beverage container, not shown. Still referring to FIG. 1 it will be seen that the upper or top surface 13 further defines, in part, a second or vent cavity 30. The vent cavity 30 is located between the first and second portions 23 and 25 of the first cavity 20. The second or vent cavity 30 is defined in part by a bottom surface 31, and by the sidewalls 21 as described above. The bottom surface 31 is located in an elevationally lower position relative to the first and second portions 23, and 25, respectively. The bottom surface 31 defines a vent aperture 32, and a biasing aperture which is generally indicated by the numeral 33. The vent aperture 32 is provided so as to allow the equalization of air pressure between the ambient environment and the internal cavity of a drinking vessel not shown, while a liquid is being consumed from a drinking vessel, not shown. The biasing aperture 33 operably cooperates with a portion of an elongated fluid dispensing member which will be discussed in greater detail, hereinafter. The vent aperture 32 is defined, in part, by an elevated sidewall 34, the function of which will be described, below. The lid body 11, and more specifically the peripheral edge 12 thereof, further defines, in part, a gasket receiving channel 35 and which circumscribes the lid body 11. The gasket receiving channel 35 is sized so as to matingly receive or cooperate with a fluid impeding gasket 36. The continuous gasket 36 sealingly engages the sidewall of a drinking vessel, not shown, such that a movement of the liquid from the internal cavity of the drinking vessel by passing between the fluid dispensing lid, and the drinking vessel, is substantially prohibited when the fluid dispensing lid is in an operational position as will be described in greater detail, hereinafter.

Figure 2:
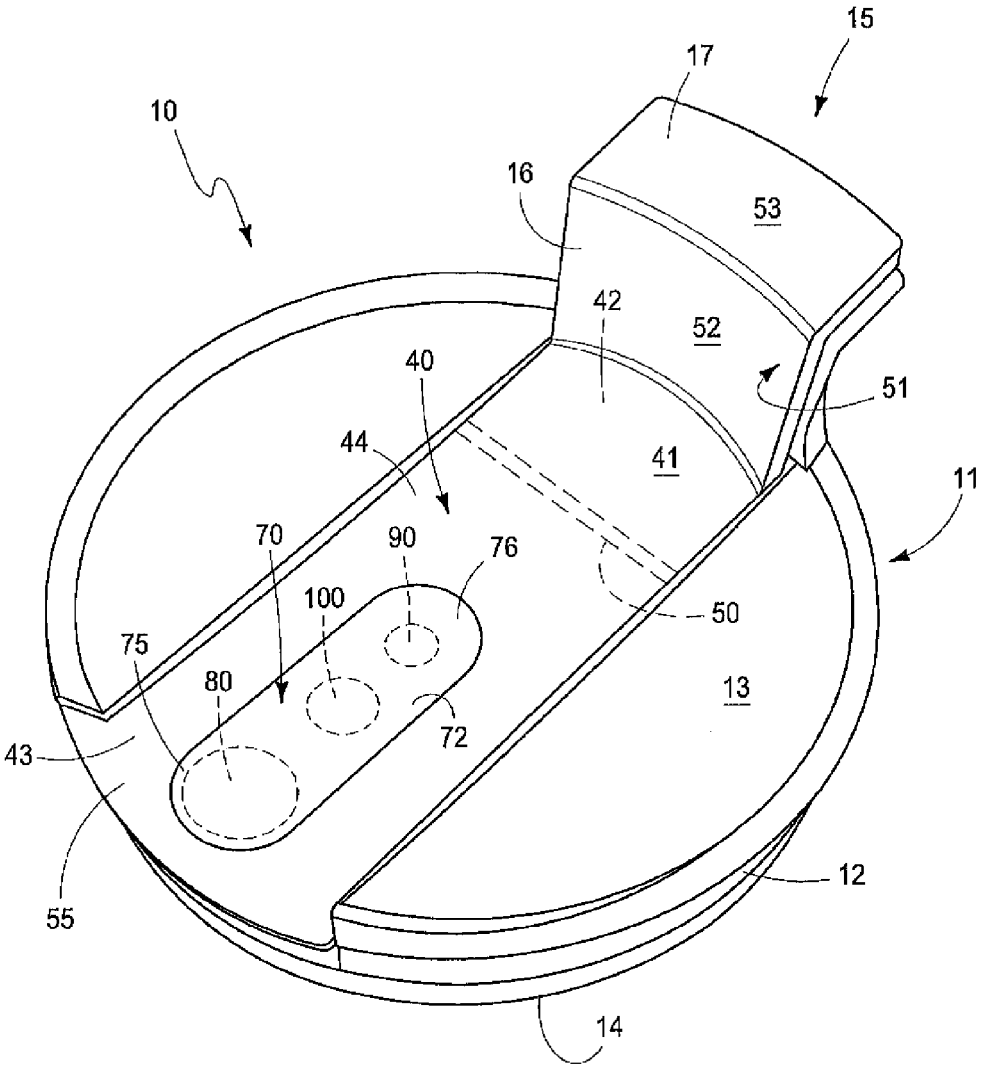
FIG. 2 is a perspective, top plan view of the fluid dispensing lid of the present invention, and which shows some underlying surfaces in phantom lines.

The liquid dispensing lid 10 of the present invention further includes a fluid dispensing member which is generally indicated by the numeral 40 in FIG. 1, and following. The fluid dispensing member has a main body 41 which is sized so as to matingly cooperate, at least in part, with the first and second cavities 20 and 30 respectively. In this regard, the main body 41 of the elongated fluid dispensing member 40 has a first end 42 which is located adjacent to the peripheral edge 12 of the lid body 11, and an opposite, second end 43. Still further, the main body 41 has a top surface 44 and an opposite bottom surface 45. The main body 41 is sized so as to be received, at least in part, within the first and second cavities 20 and 30 respectively, and to further carry and matingly cooperate with an elastomeric valve member which is moved along a given path of travel so as to facilitate the selective dispensing of a source of liquid from a drinking vessel, not shown. As illustrated in FIG. 2 and following, the top surface 64 of the main body, is positioned in a substantially co-planar orientation with the top surface 13 during a portion of the operation of the present invention.

Figure 3:
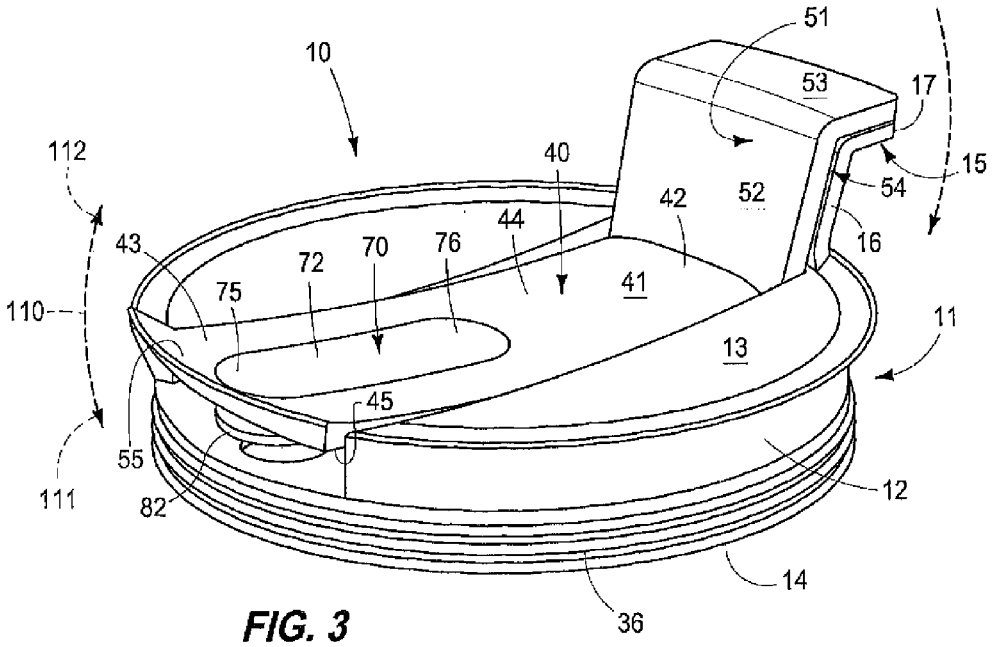
FIG. 3 is a perspective, side elevation view of a fluid dispensing lid of the present invention during operation and which results in the fluid dispensing lid being in a position to dispense fluid from a fluid storage vessel not shown.
Figure 4:
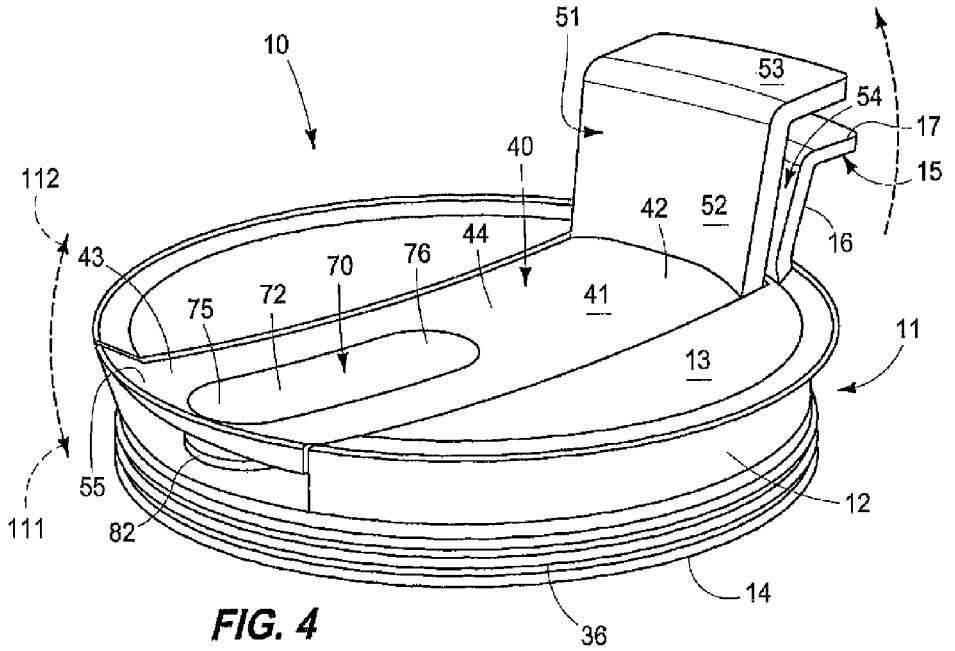
FIG. 4 is a perspective side elevation view of a fluid dispensing lid of the present invention and wherein the fluid dispensing lid is located in a position which impedes the dispensing of fluid from a fluid dispensing vessel, not shown.
Figure 5:
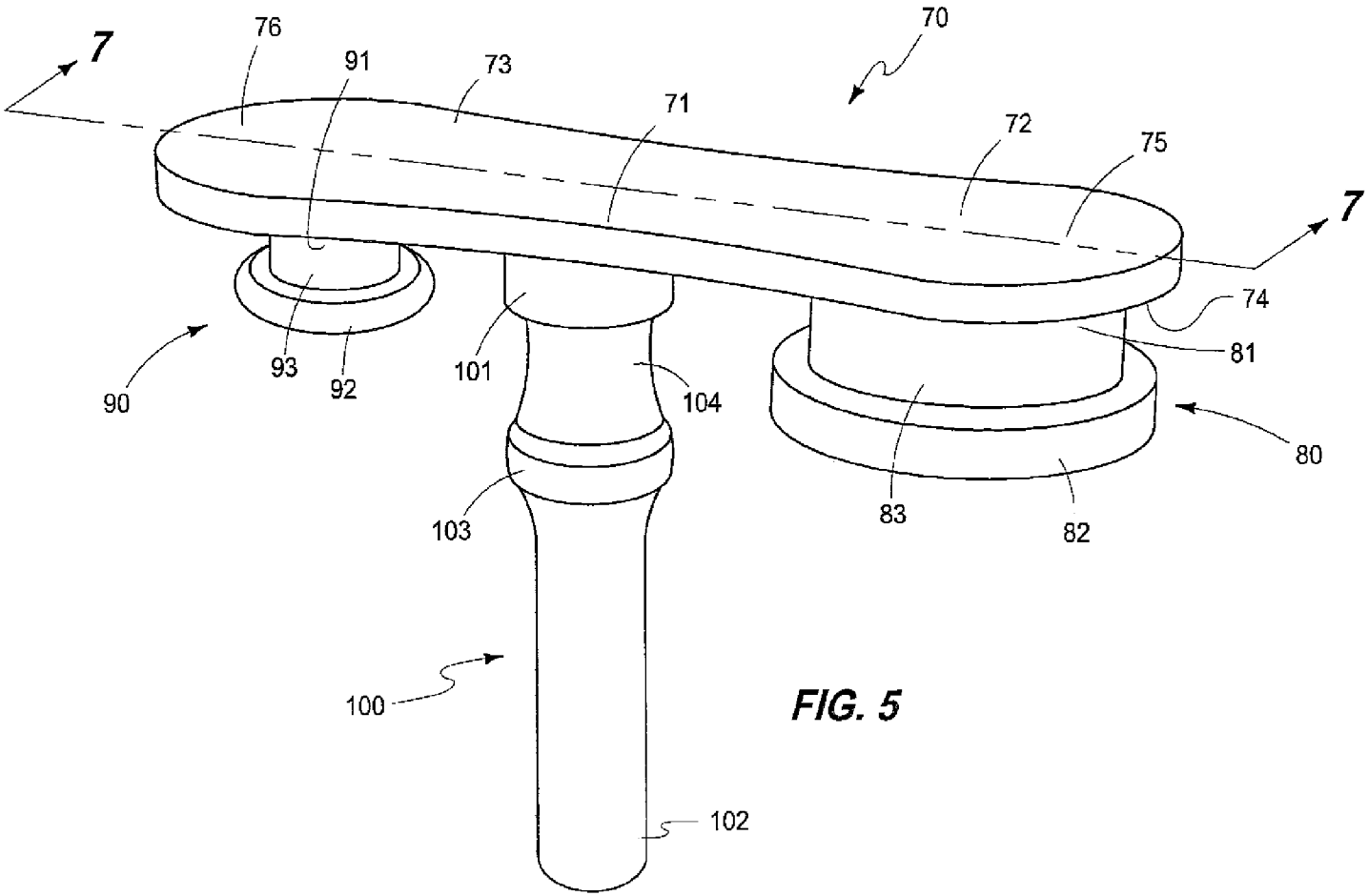
FIG. 5 is an elastomeric valve member which forms a feature of the present invention.

The fluid dispensing member 40 further includes a fulcrum 50 which is mounted on the bottom surface 45 of the main body 41. The fulcrum is dimensioned so as to be received within the fulcrum engagement region 24 as defined by the first portion 23 of the first cavity 20. The fulcrum locates the bottom surface 45 in spaced relation relative to the bottom surface 22 and which defines, in part, the first cavity 20. The fluid dispensing member 40 further is defined by an elevated platform 51 which is made integral with the first end 42 of the main body 41. The elevated platform 51 includes a first, upwardly extending portion 52, and a second, laterally outwardly extending portion which is generally indicated by the numeral 53. As seen in FIGS. 3 and 4, the elevated platform 51, during operation, is located in spaced relation 54 relative to the flange 15, and which is made integral with the lid body 11. The space 54 permits the fluid dispensing member 40 to move along a given path of travel as will be described, below. Additionally, the main body 41 of the fluid dispensing member 40 includes a raised, contoured portion 55, and which is made integral with the second end 43 thereof. The raised contoured portion 55 forms a portion of the peripheral edge 12 of the lid body 11 when the fluid dispensing member 40 is located in a position which impedes the dispensing of fluid from a fluid dispensing vessel, not shown. The flange 15 operates in a manner to define a lowermost limit of travel of the fluid dispensing member during the operation of same.

As best seen in the exploded view of FIG. 1, the fluid dispensing member 40 further defines an elongated cavity which is generally indicated by the numeral 60, and which is further formed in the top surface 44 of the main body 41. The elongated cavity 60 is located near the second end 43 thereof. The cavity 60 is defined, at least in part, by a continuous sidewall 61, and further includes a bottom surface 62 which is spaced a given distance from the top surface 44. The elongated cavity 60 defines first, second and third apertures 63, 64 and 65, respectively. When assembled, the first, second and third apertures 63, 64 and 65, respectively, are generally substantially coaxially aligned with the respective drinking aperture 26, vent aperture 32 and the biasing aperture 33, and which are further defined by the second or vent cavity 30, as earlier described. The elongated cavity 60 is operable to releasably cooperate with an elastomeric valve member which will be described in greater detail in the paragraphs which follow.

Figures 6, 7:
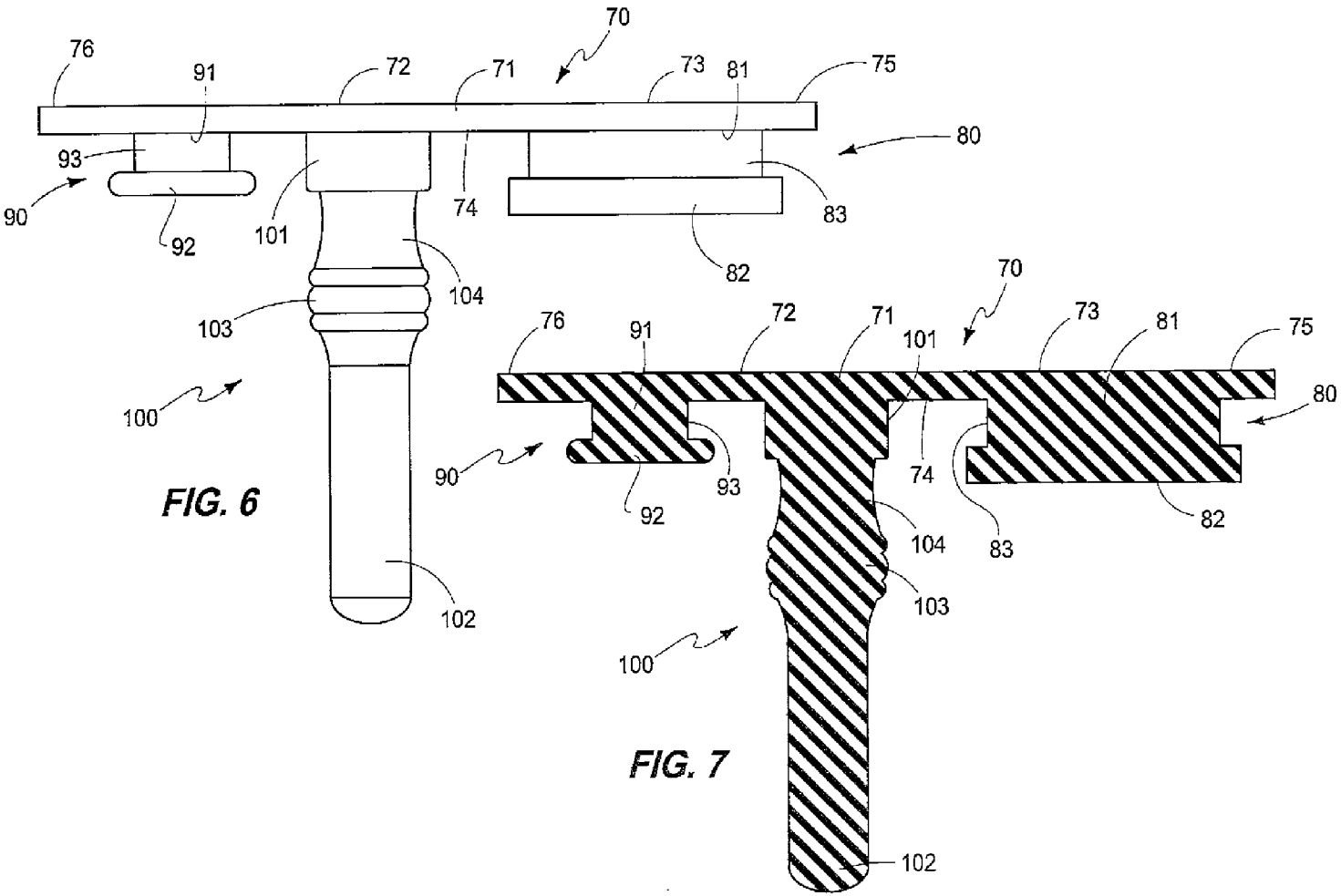
FIG. 6 is a side elevation view of the elastomeric valve member as seen in FIG. 5, and which forms a feature of the present invention.
FIG. 7 is a transverse vertical sectional view of an elastomeric valve member and which shows a biasing member in an unbiased state.
Figure 7A:
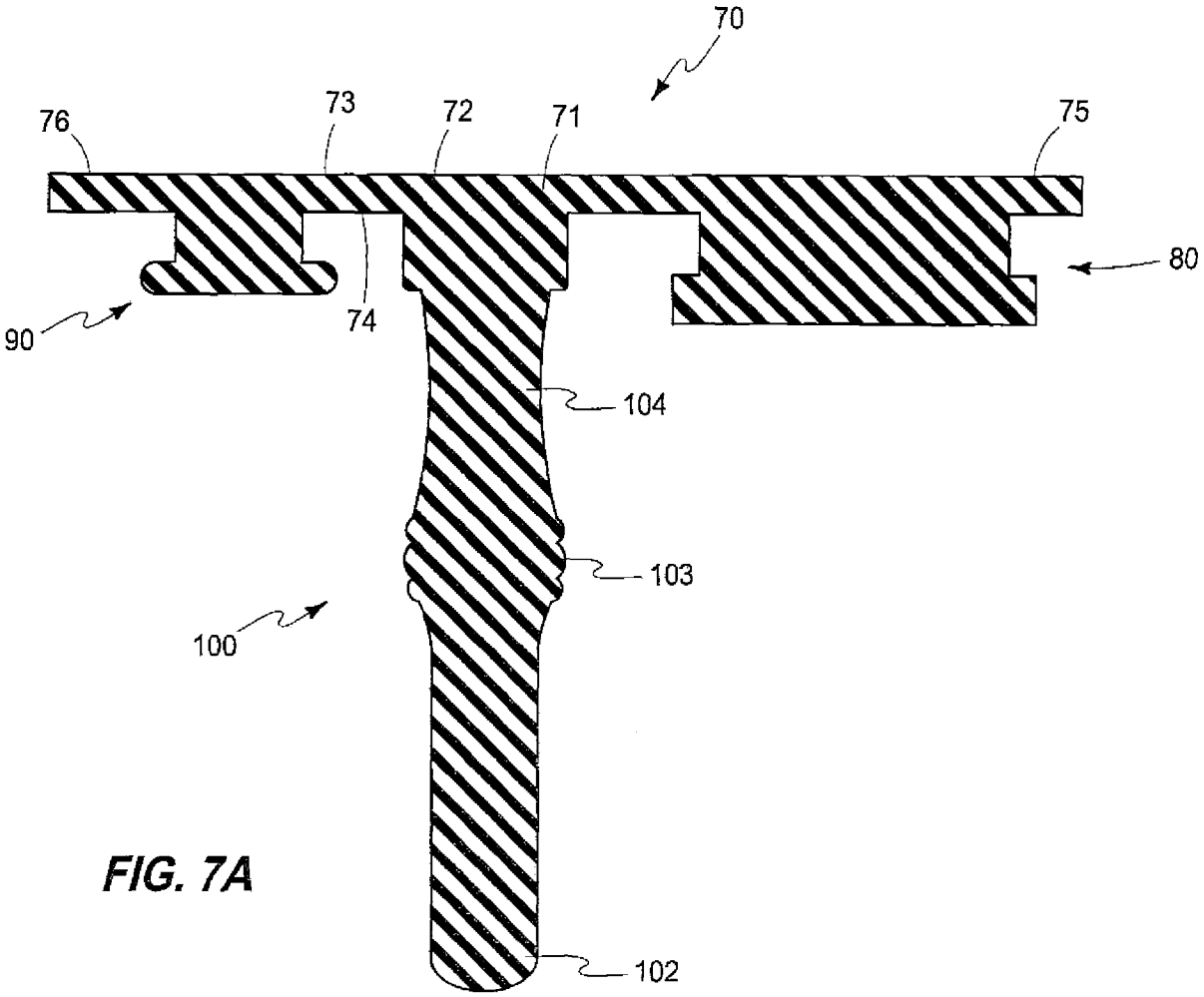
FIG. 7A is a transverse vertical sectional view of the elastomeric valve member which forms a feature of the present invention and which illustrates the elongation of a biasing member during the operation of the present invention.

Referring now to the drawings, and more specifically to FIGS. 6, 7 and 7A respectively, the liquid dispensing lid 11 of the present invention includes an elastomeric valve member which is generally indicated by the numeral 70, and which further is releasably borne by the elongated fluid dispensing member 40. The elongated elastomeric valve member 70 has a main body 71 which is defined, in part, by a planar portion 72 as seen in FIG. 1. The planar portion is sized so as to be received in sealing, mating inter-fitted relation within the elongated cavity 60 which is formed in the top surface 44 of the fluid dispensing member 40. The planar portion has a thickness dimension which is substantially equal to the depth dimension of the elongated cavity 60 as measured between the top surface 44, and the bottom surface 62. The planar portion 72 has a top surface 73 which is substantially co-planar with the top surface 44 of the main body 41. The planar portion 72 also has an opposite bottom surface 74 which rests in juxtaposed relation relative to the bottom surface 62, and which defines, in part, the elongated cavity 60. The elastomeric valve member 70 has a first end 75, and an opposite second end 76. The first end is located adjacent to the second end 43 of the fluid dispensing member 40.

The elastomeric valve member 70 includes a drinking aperture sealing member which is generally indicated by the numeral 80, and which further is made integral with the bottom surface 74, and is located adjacent to the first end 75, of the main body 71. The drinking aperture sealing member 80 has a first end 81 which is made integral with the bottom surface 74, and further has an opposite, and distal, second end 82. As seen in FIG. 7, the drinking aperture sealing member 80 has a reduced dimensioned intermediate portion 83. Further, it should be recognized that the second end 82 has a cross sectional dimension which is greater than the intermediate portion 83. The intermediate portion 83 has a length dimension which is equal to or less than the thickness dimension as measured between the top and bottom surfaces 44 and 45 of the fluid dispensing member 40. As will be recognized by a study of FIG. 1, the cross sectional dimension of the second end 82 is greater than the cross sectional dimension of the first aperture 63 which is formed in the bottom surface 62. Therefore, when the second end 82 is deformed so as to allow it to pass through the aperture 63, the planar portion 72 of the elastomeric valve member 70 is thereby secured and drawn within the cavity 60, and the second portion 82 sealably mates thereagainst the bottom surface 74. Again, it should be understood that the second end 82 has a cross sectional dimension which is also greater than the cross sectional dimension of the drinking aperture 26. As should be appreciated, the intermediate portion 83 has a cross-sectional dimension which is equal to, or slightly less than, the cross-sectional dimension of the first aperture 63. During operation the second end 82 of the drinking aperture sealing member 80 is operable to substantially occlude the drinking aperture 26 thereby preventing fluid from being dispensed therethrough.

A vent aperture sealing member 90 is made integral with or otherwise mounted to or made integral with the bottom surface 74 of the elastomeric valve member 70, and is further located near the second end 76 thereof. In another possible form of the invention, this same vent aperture sealing member may be absent. This alternative form of the invention is not shown. The vent aperture sealing member 90 has a first end 91 which is attached to the bottom surface 74 of the elastomeric valve member 70, and further has an opposite second end 92. The second end 92 has a cross sectional dimension which is greater than the first end 91, and further includes an intermediate portion 93 which is defined between the first and second ends 91 and 92. The intermediate portion 93 has a length dimension which is less than or equal to the thickness dimension as defined between the bottom surface 62 of the elongated cavity 60 and the bottom surface 45 of the fluid dispensing member 40. Further, the cross-sectional dimension of the intermediate portion 93 is equal to or just slightly less than the cross-sectional dimension of the second aperture 64. Because of the aforementioned dimensional relationships, the second end 92 is forcibly deformed to pass through the second aperture 64. Once this occurs, the second end 92 sealingly engages the bottom surface 45 of the fluid dispensing member 40. In this arrangement, the second end 92 is oriented so as to substantially occlude the vent aperture 33. Again, positioning of the second end 92 in a location where it is disposed in juxtaposed relation relative to the bottom surface 74 affects the positioning of the planar portion 72 in a secured relationship within the elongated cavity 60 which is defined by the main body 41. The length dimension of the vent aperture sealing member 90 is less than the length dimension of the drink aperture sealing member 80. This is best seen by reference to FIG. 7. This shortened length dimension is provided so as to allow the vent aperture sealing member 90 to engage the vent aperture 33 and which is defined by the elevated side wall 34, and which is located within the second or vent cavity 30. Again, the vent aperture sealing member 90 has a cross sectional dimension as measured at the second end 92, and which is less than the cross sectional dimension of the drink aperture sealing member 80 as measured at the second end 82.

The elastomeric valve member 70 includes a biasing member 100 which is made integral with the bottom surface 74, and which further is located between the drinking aperture sealing member 80, and the vent aperture sealing member 90 as best seen in FIG. 1 and following. The biasing member has a length dimension which is greater than either of the drinking aperture sealing member 80, and vent aperture sealing member 90 respectively. The biasing member has a first end 101 which is made integral with the bottom surface 74 of the elastomeric valve member 70. Further, the biasing member has a distal second end 102. As seen in the drawings, the biasing member 100 has an intermediate and enlarged engagement member 103 which has a cross sectional dimension which is greater than the cross sectional dimension of the biasing aperture 33, and which is located in the second or vent cavity 30 of the lid body 11. When the second end 102 is received through the biasing aperture 33, and further when force is applied to the second end 102, the enlarged engagement member 103 can be deformed so as to pass therethrough the biasing aperture 33 and permits the enlarged engagement member 103 to be placed in force engaging and occluding relation relative to the aperture 33, and against the bottom surface 14 of the lid body 11. As seen in the drawings, the biasing member 100 has a region 104 which is defined between the enlarged engagement member 103, and the first end 101 thereof. When force is applied to the fluid dispensing member 40 to move it along a given path of travel which will be discussed, below, the force applied to the fluid engagement member 40 is effective to move the main body thereof 41 away from the first cavity 20, and simultaneously causes the region 104 to elongate (See FIG. 7A.) The elongation of the region 104 causes an increased amount of biasing force to be exerted on the fluid dispensing member 40 such that upon release of a pressure or force exerted on the first end 42 thereof, the fluid dispensing member 40 returns to a position where it is matingly received within the first cavity 40, and the drinking aperture sealing member 80, and vent aperture sealing member 90 are placed in an occluding relationship relative to the drinking aperture 26, and vent aperture 32 so as to prevent the movement of a fluid therethrough. The arrangement of the elastomeric valve member 70 as described, above, provides a convenient means whereby a user can readily disassemble the present lid body 11 so as to allow the individual components to be easily cleaned and thus maintain the lid body in a sanitary condition notwithstanding the use of the lid body to dispense various types of liquids such as coffee, soft drinks, alcoholic beverages, and the like.

In the arrangement as seen in the drawings (FIGS. 3 and 4), and when fully assembled the elongated fluid dispensing member 40 is moveably mounted on the upper surface 13 of the lid body 11 and the fulcrum 50 rests in forcible, mating engagement with the fulcrum engagement region 21. When a force is applied to the first end 42 of the elongated fluid dispensing member 40, the second end of the fluid dispensing member 43 moves along a predetermined path of travel 110 between a first position 111, where the drinking aperture sealing member 80, and vent aperture sealing member 90 are each positioned in an occluding relationship relative to the drinking aperture 26 and vent aperture 32, respectively; to a second position 112, and where the drinking aperture sealing member 80, and vent aperture sealing member 90, are each moved to a non-occluding position relative to the drinking aperture 26, and the vent aperture 32. In the movement of the fluid dispensing member 40 along the path of travel 110, the biasing member 100, and more specifically the intermediate region 104 thereof, becomes elongated (FIG. 7A), and the biasing member 100 generates an increasing amount of biasing force which urges the fluid dispensing member 40 to move from the second position 112 back in the direction towards the first position 111. Consequently, upon release of a physical force which was previously applied by the user to the second, outwardly extending portion 53 of the elevated platform 51, the fluid dispensing member 40 moves from the second position 112 back to the first position 111. As noted above, and in the first position 111, the drinking aperture 26, and vent aperture 32 as defined by the lid body 11 are substantially occluded thus preventing the dispensing of any liquid from a drinking vessel (not shown) and which is coupled to the fluid dispensing lid 11.

Operation

The operation of the described embodiment of the present invention is believed to be readily apparent, and is briefly summarized at this point.

In its broadest aspect, the present invention relates to a liquid dispensing lid 10 which includes a lid body 11 having an upper and lower surface 13 and 14 respectively, and a peripheral edge 12. The lid body 11 is sized so as to releasably cooperate with a fluid dispensing vessel having an internal cavity (not shown). The lid body 11 further defines a drinking aperture 26, and a vent aperture 32. In the arrangement as seen in the drawings, an elongated fluid dispensing member 40 is movably mounted on the upper surface 13 of the lid body 11. Still further the present invention includes an elastomeric valve member 70 which is releasably borne by the elongated fluid dispensing member 40. The elongated valve member 40 has a drinking aperture sealing member 90, a vent aperture sealing member 90; and a biasing member 100 which biasingly couples the elongated fluid dispensing 40 to the lid body 11. The elongated fluid dispensing member 40 is movable along a predetermined path of travel 110 between a first and a second position 111 and 112, respectively, and which controllably permits the dispensing of a liquid from an associated drinking vessel. As earlier discussed, and in one possible form of the invention, the vent aperture sealing member might be eliminated.

More specifically, the present invention relates to a liquid dispensing lid 10 which includes a lid body 11 having an upper and lower surface 13 and 14, and which further is defined by a peripheral edge 12. The lid body 11 is sized so as to releasably cooperate with a fluid dispensing vessel having an internal cavity which encloses a source of a liquid to be dispensed (not shown). The lid body 11 further defines a drinking aperture 26, and a vent aperture 32 which extend through the lid body 11 and which further communicate with the internal cavity of the fluid dispensing vessel. As seen in the drawings, the drinking aperture 26 has a cross sectional dimension which is greater than the cross sectional dimension of the vent aperture 32. In the arrangement as seen in the drawings, an elongated fluid dispensing member 40 is movably mounted on the upper surface 13 of the lid body 11. The fluid dispensing member 40 has opposite first and second ends 42 and 43, respectively, and top and bottom surfaces 44 and 45, respectively. The fluid dispensing member 40 further defines a fulcrum 50 which is mounted on the bottom surface 45 thereof, and which is further located between the first and second ends 42 and 43, respectively. The fulcrum 50 rests in forcible engagement with the lid body 11. When a force is applied to the first end 42 of the elongated fluid dispensing member 40 by the user, the second end 43 of the fluid dispensing member 40 moves along a predetermined path of travel 110 between a first and second position 111 and 112, respectively, relative to the drink and vent apertures 26 and 32, respectively. An elastomeric valve member 70 is provided, and which is further releasably borne by the second end 43, of the elongated fluid dispensing member 40. The elongated elastomeric valve member 70 has a drinking aperture sealing member 80; a vent aperture sealing member 90; and a biasing member 100 which biasingly couples the second end 43 of the fluid dispensing member 40 to the upper surface 13 of the lid body 11. The biasing member 100 blasingly urges the elongated fluid dispensing member 40 into the first position 111, and along the path of travel 110 when no force is applied by the user to the first end 42 of the elongated fluid dispensing member 40. In the first position 111, the drinking and vent apertures 26 and 32, respectively, are sealingly occluded by the respective drinking and vent sealing members 80 and 90 respectively. On the other hand, when force is applied by the user to the first end 42 of the elongated fluid dispensing member 40 so as to move the second end 43 along the path of travel 110, and to the second position 112, the elongated fluid dispensing member 40 simultaneously carries each of the drinking and vent sealing members 80 and 90 respectively to a non-occluding position relative to each of the drinking and vent apertures 26 and 32 respectively so as to facilitate a release of the fluid or other liquid from the internal cavity of the drinking vessel, and through the drinking aperture 26. The movement of the elongated fluid dispensing member 40 from the first to the second positions 111 and 112, respectively, is effective in resiliently elongating the biasing member 100 (FIG. 7A). It should be understood that upon a release of the force applied to the first end 42 of the elongated fluid dispensing member 40 by the user, the biasing member 100 biasingly returns to the second end 43 of the elongated fluid dispensing member 40 to the first position 111. In the first position, the elongated fluid dispensing member 40 impedes the dispensing of the fluid or other liquid from the drinking vessel upon which the fluid dispensing lid 11 is mounted.

Therefore, it will be seen that the present invention provides many advantages over various fluid dispensing lids which have been utilized heretofore. Chief among the advantages which are provided by the present invention is the ability for the present invention to be readily disassembled so that the user thereof may conveniently clean the liquid dispensing lid so as to maintain a sanitary condition such that the liquid dispensing lid may be used to dispense various liquids such as water, carbonated beverages, coffee, alcoholic beverages and diverse other beverages of choice.

In compliance with the statute of the invention has been described in language more or less specific as to structural and methodological features. It is to be understood, however, that the invention is not limited to the specific features shown and described since the means herein disclosed comprise preferred forms of putting the invention into effect. The invention is therefore, claimed in any of its forms or modifications within the proper scope of the appended claims appropriately interpreted in accordance with the doctrine of equivalence.

We claim:

1. A liquid dispensing lid, comprising:

a lid body having an upper and lower surface, and a peripheral edge, and wherein the lid body is sized so as to releasably cooperate with a fluid dispensing vessel having an internal cavity, and wherein the lid body further defines a drinking aperture and a vent aperture, and wherein the drinking aperture and vent aperture each extend through the lid body and further communicate with the internal cavity of the fluid dispensing vessel, and wherein an elastomeric value member further has a vent aperture sealing member;

an elongated, fluid dispensing member moveably mounted on the upper surface of the lid body; and the elastomeric valve member is releasably borne by the elongated fluid dispensing member, and wherein the valve member has a drinking aperture sealing member, and a biasing member which biasingly couples the fluid dispensing member to the lid body, and wherein the elongated, fluid dispensing member is moveable along a predetermined path of travel between a first and second position, and wherein, when the elastomeric valve member is located in the first position, the drinking aperture sealing member and vent aperture sealing member are each located in a substantially occluding position relative to the drinking aperture, and vent aperture, respectively, so as to prevent a release of a fluid which is contained within the internal cavity of the fluid dispensing vessel, and wherein when force is applied to the elongated fluid dispensing member so as to move the elongated fluid dispensing member along the path of travel to the second position, the elongated fluid dispensing member simultaneously carries each of the drinking and vent sealing members to a non-occluding position relative to each of the drinking and vent apertures so as to facilitate a release of a fluid which is contained within the internal cavity of the fluid dispensing vessel, and wherein the movement of the elongated fluid dispensing member along the path of travel is effective in resiliently elongating the biasing member, and wherein upon release of the force applied to the elongated fluid dispensing member the elongated biasing member biasingly returns the elongated fluid dispensing member along the path of travel, to the first position, and which impedes the dispensing of the fluid from the fluid dispensing vessel.

2. A liquid dispensing lid as claimed in claim 1, and wherein the elongated fluid dispensing member has opposite first and second ends, a top surface and a bottom surface, and wherein the elastomeric valve member is borne on the second end of the elongated, fluid dispensing member.

3. A liquid dispensing lid as claimed in claim 2, and wherein the elongated fluid dispensing member further defines a fulcrum which is mounted on the bottom surface thereof, and wherein the fulcrum rests in forcible engagement on the upper surface of the lid body, and wherein the force, when applied to the elongated fluid dispensing member, causes the elongated fluid dispensing member to move along the predetermined path of travel between the first and second position relative to the drinking and vent apertures, respectively.

4. A liquid dispensing lid as claimed in claim 1, and wherein the elastomeric valve member biasingly urges the elongated fluid dispensing member into the first position along the path of travel when no force is applied to the elongated fluid dispensing member.

5. A liquid dispensing lid, comprising:

a lid body having an upper and lower surface, and a peripheral edge, and wherein the lid body is sized so as to releasably cooperate with a fluid dispensing vessel having an internal cavity, and wherein the lid body further defines a drinking aperture and a vent aperture which extend through the lid body and which further communicate with the internal cavity of the fluid dispensing vessel, and wherein the lid body is further defined by a continuous gasket which is mounted near the lower surface of the lid body;

an elongated, fluid dispensing member moveably mounted on the upper surface of the lid body, and having opposite first and second ends, a top surface, and a bottom surface, and wherein the fluid dispensing member defines a fulcrum which is mounted on the bottom surface thereof, and wherein the fulcrum rests in forcible engagement with the upper surface of the lid body, and wherein a force, when applied to the fluid dispensing member moves the fluid dispensing member along a predetermined path or travel between a first and second position relative to the drinking and vent apertures, respectively; and an elastomeric valve member which is releasably borne by the elongated fluid dispensing member, and wherein the valve member has a drinking aperture sealing member, a vent aperture sealing member, and a biasing member which biasingly couples the fluid dispensing member to the lid body, and wherein the biasing member biasingly urges the fluid dispensing member into the first position along a path of travel when no force is applied to the fluid dispensing member, and wherein, when force is applied to the fluid dispensing member so as to move the fluid dispensing member along the path of travel to the second position, the fluid dispensing member simultaneously carries each of the drinking and vent sealing members to a non-occluding position relative to each drinking and vent apertures so as to facilitate a release of a fluid which is enclosed within the internal cavity of the fluid dispensing vessel, and through the drinking aperture, and wherein the movement of the elongated fluid dispensing member along the path of travel is effective in resiliently elongating the biasing member, and wherein, upon release of the force applied to the elongated fluid dispensing member, the elongated biasing member biasingly returns the elongated fluid dispensing member along the path of travel to the first position, and which impedes the dispensing of the fluid from the fluid dispensing vessel.

6. A liquid dispensing lid as claimed in claim 5, and wherein the upper surface of the lid body further defines a first cavity, and wherein the first cavity mechanically cooperates with the elongated fluid dispensing member such that the elongated fluid dispensing member remains substantially flush with the upper surface of the lid body when no force is applied to the elongated fluid dispensing member.

7. A liquid dispensing lid as claimed in claim 5, and wherein the upper surface of the lid body is further defined by a vent cavity, and wherein the vent cavity has a cross sectional dimension greater than the cross sectional dimension of the vent aperture, and wherein the vent cavity is further defined, at least in part, by a biasing aperture which matingly cooperates with the biasing member.

8. A liquid dispensing lid as claimed in claim 5, and wherein the upper surface of the lid body is further defined by a flange, and wherein the flange mechanically cooperates with the elongated fluid dispensing member by defining a lower limit of movement of the elongated fluid dispensing member along the path of travel.

9. A liquid dispensing lid as claimed in claim 5, and wherein the continuous gasket which is mounted near the lower surface of the lid body sealingly engages the internal cavity of the fluid dispensing vessel such that movement of the liquid from the internal cavity of the drinking vessel is prohibited when the second end of the elongated fluid dispensing member is located in the first position along the path of travel.

10. A liquid dispensing lid as claimed in claim 5, and wherein the first end of the elongated fluid dispensing member is further defined by an elevated platform, and wherein the elevated platform is positioned a predetermined vertical distance above the flange which is made integral with the upper surface of the lid body when the elongated fluid dispensing member is located in the first position.

11. A liquid dispensing lid as claimed in claim 5, and wherein the second end of the elongated fluid dispensing member is further defined by a raised contoured portion, and wherein, when the second end of the fluid dispensing member is in the first position, the raised contoured portion cooperates with the upper surface of the lid body and forms, at least in part, a portion of the peripheral edge thereof.

12. A liquid dispensing member as claimed in claim 5, and wherein the top surface of the elongated fluid dispensing member is further defined by a cavity, and which cooperates with the elastomeric valve member such that a portion of the valve member remains substantially flush with the top surface of the elongated fluid dispensing member.

13. A liquid dispensing lid as claimed in claim 5, and wherein the elongated fluid dispensing member is further defined by at least one aperture which extends through the elongated fluid dispensing member, and wherein the at least one aperture is coaxially aligned with at least one of the drinking aperture, the vent aperture and the biasing aperture when the second end of the elongated fluid dispensing member is located in the first position along the path of travel.

14. A liquid dispensing lid as claimed in claim 5, and wherein the drinking aperture and the vent aperture are normally in the closed position, and wherein actuation of the elongated fluid dispensing member moves the drinking aperture and vent aperture to an open position.

15. A liquid dispensing lid as claimed in claim 5, and wherein the elastomeric valve member has a first portion, which is located in a substantially coplanar orientation relative to the top surface of the elongated fluid dispensing member; a bottom surface; and opposite first and second ends, and wherein the drinking aperture sealing member; the vent aperture sealing member, and the biasing member depend downwardly from the bottom surface of the elastomeric valve member and pass, at least partially, into the lid body.

16. A liquid dispensing lid as claimed in claim 15, and wherein the drink aperture sealing member depends downwardly from the bottom surface of the elastomeric valve member a greater distance than the vent aperture sealing member.

17. A liquid dispensing lid as claimed in claim 15, and wherein the biasing member downwardly depends from the bottom surface of the elastomeric valve member a greater distance than the drink aperture sealing member.

18. A liquid dispensing lid as claimed in claim 5, and wherein the drink aperture sealing member has a cross sectional dimension which is equal to or greater than the cross sectional dimension of the drinking aperture, and wherein when the elongated fluid dispensing member is in the first position, the drinking aperture sealing member occludes the drinking aperture.

19. A liquid dispensing lid as claimed in claim 5, and wherein the vent aperture sealing member has a cross sectional dimension which is equal to or greater than the cross sectional dimension of the vent aperture, and wherein when the elongated fluid dispensing member is in the first position, the vent aperture sealing member occludes the vent aperture.

20. A liquid dispensing lid, comprising:

a lid body having an upper and lower surface, and which is further defined by a peripheral edge, and wherein the lid body is sized so as to releasably cooperate with a fluid dispensing vessel having an internal cavity and which encloses a source of a liquid to be dispensed, and wherein the lid body further defines a drinking aperture, and a vent aperture, which extend through the lid body, and which communicate with the internal cavity of the fluid dispensing vessel, and wherein the drinking aperture has a cross sectional dimension which is greater than a cross sectional dimension of the vent aperture;

an elongated, fluid dispensing member which is moveably mounted on the upper surface of the lid body, and wherein the fluid dispensing member has opposite first and second ends, and top and bottom surfaces, and wherein the fluid dispensing member defines a fulcrum which is mounted on the bottom surface thereof, and is further located between the first and second ends thereof, and wherein the fulcrum rests in forcible engagement on the upper surface of the of the lid body, and wherein, when a force applied to the first end of the elongated fluid dispensing member, the second end of the fluid dispensing member moves along a predetermined path er of travel between a first and second position relative to the drinking and vent apertures respectively; and an elastomeric valve member which is releasably borne by the second end of the elongated fluid dispensing member, and wherein the valve member has a drinking aperture sealing member, a vent aperture sealing member, and a biasing member which biasingly couples the second end of the fluid dispensing member to the upper surface of the lid body, and wherein the biasing member biasingly urges the elongated fluid dispensing member into the first position along the path of travel when no force is applied to the first end of the elongated fluid dispensing member, and wherein, in the first position, the drinking and vent apertures are sealingly occluded by the respective drinking and vent sealing members, and wherein, when force is applied to the first end of the elongated fluid dispensing member so as to move the second end thereof along the path of travel, and to the second position, the elongated fluid dispensing member simultaneously carries each of the drinking and vent sealing members to a non-occluding position relative to each drinking and vent apertures so as to facilitate a release of the fluid from the internal cavity of the fluid dispensing vessel, and through the drinking aperture, and wherein the movement of the elongated fluid dispensing member from the first to the second position is effective in resiliently elongating the biasing member, and wherein, upon release of the force applied to the first end of the elongated fluid dispensing member, the biasing member biasingly returns the second end of the elongated fluid dispensing member to the first position, and which impedes the dispensing of the fluid from the fluid dispensing vessel.

21. A liquid dispensing lid as claimed in claim 20, and wherein the upper surface of the lid body further defines a first cavity, and wherein the first cavity matingly cooperates with the elongated fluid dispensing member such that the second end of the elongated fluid dispensing member remains in a substantially coplanar orientation relative to the upper surface of the lid body when the second end of the elongated fluid dispensing member is in the first position.

22. A liquid dispensing lid as claimed in claim 20, and wherein the upper surface of the lid body is further defined by a vent cavity which is located adjacent to the vent aperture, and wherein the vent cavity has a cross sectional dimension greater than a cross sectional dimension of the vent aperture, and wherein the vent cavity further defines a biasing aperture which matingly cooperates with the biasing member.

23. A fluid dispensing lid as claimed in claim 20, and wherein the upper surface of the lid body is further defined by a flange which is located, at least in part, along the peripheral edge of the lid body and positioned opposite to the drinking aperture, and wherein the flange mechanically cooperates with the elongated fluid dispensing member by defining a lower limit of movement for the first end of the elongated fluid dispensing member as the elongated fluid dispensing member moves along the path of travel.

24. A fluid dispensing lid as claimed in claim 20, and further comprising a continuous gasket which is mounted near the lower surface of the lid body, and which further sealingly engages the fluid dispensing vessel such that a movement of the liquid from the internal cavity of the drinking vessel by passing between the fluid dispensing lid, and the drinking vessel is prohibited when the second end of the elongated fluid dispensing member is in one of the first or second positions.

25. A fluid dispensing lid as claimed in claim 20, and wherein the first end of the elongated fluid dispensing member is further defined by an elevated force receiving platform, and wherein the elevated force receiving platform is positioned a predetermined vertical distance above the flange of the lid body when the elongated fluid dispensing member is in the first position.

26. A fluid dispensing lid as claimed in claim 25, and wherein the second end of the elongated fluid dispensing member is further defined by an elevated portion, relative to the top surface of the elongated fluid dispensing member, and wherein, when the second end of the fluid dispensing member is in the first position, the elevated portion matingly cooperates with the upper surface of the lid body and forms, at least in part, a portion of the peripheral edge thereof.

27. A fluid dispensing member as claimed in claim 20, and wherein the top surface of the elongated fluid dispensing member is further defined by a cavity, which is located between the first and second ends of the elongated fluid dispensing member, and which matingly cooperates with the elastomeric valve member such that the valve member remains substantially coplanar with the top surface of the elongated fluid dispensing member.

28. A liquid dispensing lid as claimed in claim 27, and wherein the elastomeric valve member has a planar portion which is sized so as to be matingly received within the cavity which is located between the first and second ends of the elongated fluid dispensing member, and wherein the planar portion is oriented in a substantially coplanar position relative to the top surface of the elongated fluid dispensing member, and wherein the elastomeric valve member further has a bottom surface, and opposite first and second ends, and wherein the drinking aperture sealing member is located adjacent to the first end of the elastomeric valve member, and the vent aperture sealing member is located adjacent to the second end of the elastomeric valve member, and wherein the biasing member is located between the drinking aperture sealing member, and the vent aperture sealing member, and wherein the drinking aperture sealing member, vent aperture sealing member, and the biasing member depend downwardly from the bottom surface of the elastomeric valve member and are received, at least in part, in the lid body.

29. A liquid dispensing lid as claimed in claim 28, and wherein the drinking aperture and vent aperture sealing members each depend, downwardly relative to the bottom surface of the elastomeric valve member at a predetermined distance, and wherein the biasing member depends downwardly relative to the bottom surface at a greater distance than each of the vent and drinking aperture sealing members.

30. A liquid dispensing lid as claimed in claim 29, and wherein the drinking aperture sealing member has a cross sectional dimension which is equal to or greater than a cross sectional dimension of the drinking aperture, and wherein, when the liquid dispensing member is in the first position, the drinking aperture sealing member substantially occludes the drinking aperture.

31. A liquid dispensing lid as claimed in claim 30, and wherein the vent aperture sealing member has a cross sectional dimension which is equal to or greater than the cross sectional dimension of the vent aperture, and wherein, when the liquid dispensing member is in the first position, the vent aperture sealing member substantially occludes the vent aperture.

32. A liquid dispensing lid as claimed in claim 20, and wherein the elongated fluid dispensing member is further defined by a plurality of apertures which extend through the elongated fluid dispensing member, and which are further located between the first and second ends of the elongated fluid dispensing member, and wherein the respective apertures are individually coaxially aligned with each of the drinking aperture; the vent aperture; and the biasing aperture when the second end of the elongated fluid dispensing member is in the first position.

33. A liquid dispensing lid as claimed in claim 20, and wherein the drinking aperture and the vent aperture are normally in an occluded, closed position, and wherein forcible engagement of the first end of the elongated fluid dispensing member causes the drinking aperture and vent aperture to be placed in an open, non-occluded position.

* * * * *